US006762558B2

(12) United States Patent
Roelevink

(10) Patent No.: US 6,762,558 B2
(45) Date of Patent: Jul. 13, 2004

(54) LOW-PRESSURE GAS DISCHARGE LAMP

(75) Inventor: Bauke Jacob Roelevink, Roosendaal (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/232,736

(22) Filed: Aug. 29, 2002

(65) Prior Publication Data

US 2003/0057865 A1 Mar. 27, 2003

(30) Foreign Application Priority Data

Sep. 5, 2001 (EP) ..... 01203347

(51) Int. Cl.[7] ..... H01J 17/16; H01J 13/46

(52) U.S. Cl. ..... 313/634; 313/636; 313/317; 315/56; 315/58

(58) Field of Search ..... 313/634, 635, 313/636, 317, 238, 567, 631, 607, 625; 315/58, 56, 57, 60; 362/362, 376

(56) References Cited

U.S. PATENT DOCUMENTS

| | | | | |
|---|---|---|---|---|
| 5,300,860 | A * | 4/1994 | Godyak et al. | 315/39 |
| 6,465,955 | B1 * | 10/2002 | Kraus et al. | 313/567 |
| 6,507,151 | B1 * | 1/2003 | Kraus et al. | 313/631 |
| 2002/0114171 | A1 * | 8/2002 | Yoo et al. | 362/561 |

* cited by examiner

*Primary Examiner*—Tuyet T. Vo

(57) ABSTRACT

Low-pressure gas discharge lamp provided with a discharge vessel (1) enclosing a discharge space provided with a gas filling in a gastight manner, the discharge vessel (1) having tubular end portions each with a capacitive coupling element (2) made from an electrically insulating material for producing and maintaining a discharge in the discharge space. The lamp is structurally confined to prevent the occurrence of (hair) cracks in a wall of the discharge vessel as a result of piezoelectric properties of the electrically insulating material.

10 Claims, 1 Drawing Sheet

LOW-PRESSURE GAS DISCHARGE LAMP

Figure 1:
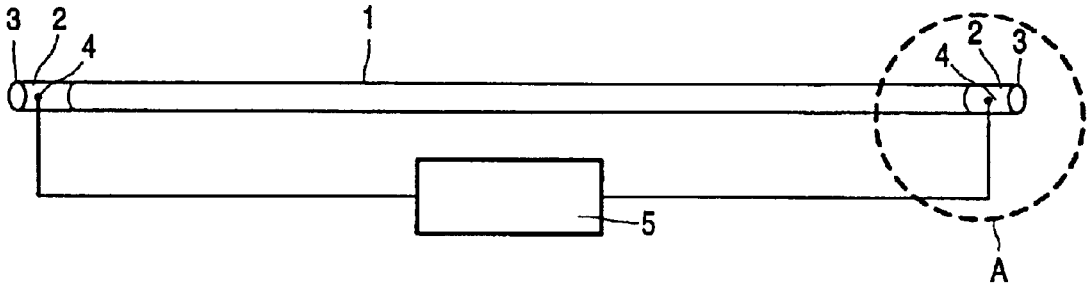

The invention relates to a low-pressure gas discharge lamp comprising a discharge vessel which encloses a discharge space provided with a gas filling in a gastight manner, which discharge vessel comprises tubular end portions each with a capacitive coupling element made of an electrically insulating material for generating and maintaining a discharge in the discharge space.

Gas discharge lamps have until now consisted of a discharge vessel filled with a filling of, for example, mercury and a rare gas in which the discharge takes place, as well as usually two metal electrodes fused into the discharge vessel. One of the electrodes supplies the electrons necessary for the discharge, which electrons are returned to the external current circuit again via the other electrode. The generation of electrons usually takes place through glow emission (hot electrodes), or alternatively through emission in a strong electric field or directly through ion bombardment (cold electrodes). In an inductive mode of operation, the electrons are directly produced in the gas filling across an electromagnetic AC field of high frequency (typically of the order of 1 MHz in the case of low-pressure gas discharge lamps). The electrons then move along closed trajectories inside the discharge vessel, and the usual electrodes are absent. Capacitive coupling elements are used as the electrodes in the case of a capacitive mode of operation. These elements are often formed from electrically insulating materials ("dielectrics") which at one end extend into the discharge vessel and at the other end are connected with electrical conduction to the external current circuit (for example by means of an interposed metal contact). An AC voltage applied to the capacitive electrodes creates an AC electric field in the discharge vessel, with the result that the electrons move along electric field lines of the AC field.

It is a disadvantage of capacitive gas discharge lamps that they generally are found to have a shorter useful life than the gas discharge lamps mentioned further above, in which the generation of electrons is achieved through glow emission.

It is an object of the invention to counteract the disadvantage of the prior art as mentioned above, i.e. to provide a gas discharge lamp of the capacitive type which has a longer operational life than was hitherto usual.

According to the invention, a gas discharge lamp of the kind mentioned in the opening paragraph is for this purpose characterized in that the lamp is provided with means for preventing the occurrence of (hair) cracks in a wall of the discharge vessel as a result of piezoelectric properties of the electrically insulating material. The invention is based on the recognition not previously reached that the operational life of known gas discharge lamps is limited by the fact that the electrically insulating material ("dielectric") of the capacitive coupling elements also has an undesirable side effect, i.e. that it has piezoelectric properties caused by the usually high dielectric constant of the material, which may give rise to vibrations in said material, which in its turn may lead to (hair) cracks in the (glass) wall of the discharge vessel, with all the adverse effects thereof on lamp life. These effects are considerably reduced if the coupling elements after an initial starting phase are heated up to the Curie temperature of the material during switching-on of the lamp.

In a preferred embodiment of a low-pressure gas discharge lamp according to the invention, said means comprise the wall of the discharge vessel, said wall having at least one region of reduced thickness. Said region is formed in particular by a circumferential region, i.e. the region extends along part of the length of the wall of the discharge vessel along the circumference thereof. Providing the wall with a smaller thickness locally, i.e. at the area of said region of the wall, achieves that the wall is heated up more quickly in said area owing to a smaller thermal mass, and accordingly reaches its Curie temperature more quickly. Moreover, said region acts as a vibration damper for the remaining portion of the wall, especially if said region is situated adjacent the joint between the capacitive coupling element and the wall of the discharge vessel.

In a further preferred embodiment of a low-pressure gas discharge lamp according to the invention, said region has a thickness smaller than 0.4 mm. Research has shown that such a thickness for this region prevents the occurrence of said (hair) cracks owing to piezoelectric properties of the electrically insulating material of the coupling elements, while nevertheless a sufficient mechanical strength of the discharge vessel wall is obtained.

In a further preferred embodiment of a low-pressure gas discharge lamp according to the invention, at least substantially the entire wall of the discharge vessel has a thickness smaller than 0.4 mm.

In a further preferred embodiment of a low-pressure gas discharge lamp according to the invention, the capacitive coupling elements have a reduced thickness at their ends facing towards the tubular end portions of the discharge vessel. In another preferred, modified version, the capacitive coupling elements also have a reduced thickness at their ends facing away from the tubular end portions of the discharge vessel. In either case, the wall of the discharge vessel may be connected to the capacitive coupling elements adjacent the thinner ends thereof, so that fewer vibrations are introduced into the wall, while in the latter case also a closing cap connected to the ends facing away from the tubular end portions of the discharge vessel is subjected to vibrations to a lesser degree.

Figure 2:
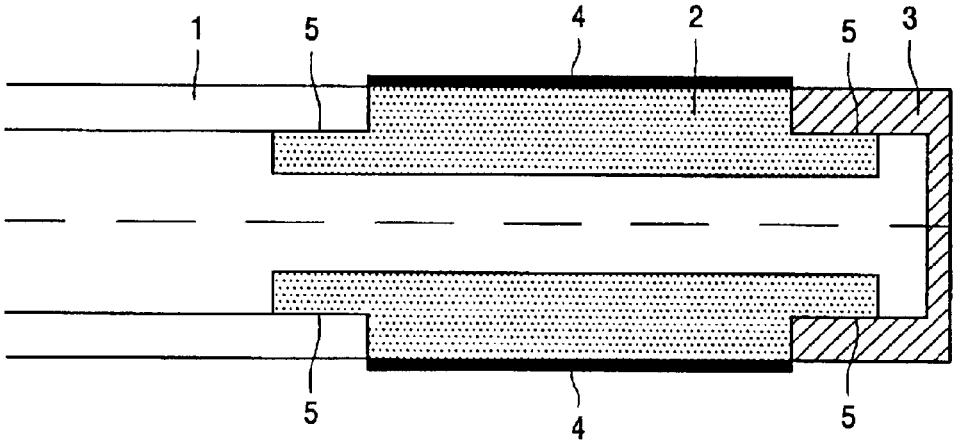
Figure 3:
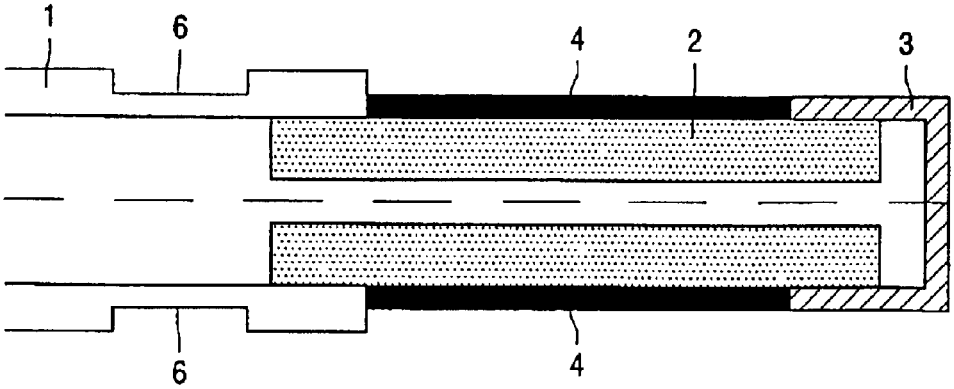

The invention will now be explained in more detail with reference to Figures shown in a drawing, in which:

FIG. 1 diagrammatically shows an embodiment of a low-pressure gas discharge lamp according to the invention;

FIG. 2 is a diagrammatic cross-sectional view of a low-pressure discharge lamp in a first preferred embodiment of the invention; and FIG. 3 corresponds to FIG. 2 but refers to a second preferred embodiment.

In FIG. 1, a low-pressure gas discharge lamp of the capacitive type can be seen, provided with a glass tube 1 which serves as a discharge vessel. The glass tube 1 provided with a phosphor layer on its inner surface has an internal diameter of 3 mm, and external diameter of 4 mm, and a length of 40 cm, and is filled with 5 mbar argon and 5 mg mercury. A coupling element in the form of a cylinder 2 of an electrically insulating material is fastened to each of the two ends of the glass tube 1. The dielectric cylinder 2 has an outer diameter of 4 mm, a wall thickness of 0.5 mm, and a length of 10 cm. The glass tube 1 is sealed off in a vacuumtight manner by the coupling elements 2 with the use of a fusion technique and of an electrically insulating closing cap 3. A silver layer is provided locally on each of the electrically insulating coupling elements 2 so as to serve as an electrical contact surface 4. The lamp is electrically connected to an external current source by means of these electrical contact surfaces 4. The external current source is formed, for example, by a supply circuit (not shown), which delivers a current of 30 mA at 40 kHz and an average voltage of approximately 350V. The lamp generates a luminous flux of approximately 6001 lumens in the stationary operating state.

FIGS. 2 and 3 are diagrammatic cross-sectional views of a detail A as indicated in FIG. 1. In the embodiment shown in FIG. 2, the capacitive coupling element 2 is constructed so as to have a reduced thickness both at its end facing towards the end portion of the glass tube 1 (i.e. where the coupling element 2 is mounted to the glass tube) and at its end facing towards the closing cap 3 (i.e. where the coupling element 2 is mounted to the closing cap 3), preferably a thickness smaller than 0.4 mm. These ends of reduced thickness are referenced 5. The ends 5 serve as vibration dampers, such that fewer vibrations are transmitted to the glass tube 1 and to the closing cap 3. FIG. 3 shows the situation where the glass tube 1 has a circumferential region 6 of smaller thickness (in particular below 0.44 mm) adjacent its end portion (in this case where the glass tube 1 and the coupling element 2 are interconnected). The regions 6 serve as vibration dampers, as did the ends 5 above, and the regions 6 are heated up more quickly than normal to the Curie temperature (owing to their smaller thermal mass) when the lamp is switched on. At this temperature, as was noted before, said vibration effects caused by piezoelectric properties of the material of the coupling element 2 no longer occur. It is noted that the lamp of FIG. 1 is constructed in accordance with the modification of FIG. 2 or 3 at both its ends.

The invention is not limited to the embodiments described above, but also covers alternative embodiments falling within the scope of the appended claims.

While the embodiments of the invention disclosed herein are presently considered to be preferred, various changes and modifications can be made without departing from the spirit and scope of the invention. The scope of the invention is indicated in the appended claims and all changes that come within the meaning and range of equivalents are intended to be embraced therein.

What is claimed is:

1. A low pressure gas discharge lamp, comprising:

a discharge vessel enclosing a discharge space provided with a gas filing in a gastight manner; and a first capacitive coupling element coupled to said discharge vessel to facilitate a generation of a discharge in said discharge space, said first capacitive coupling element including a first electrically insulating material wherein at least one of said discharge vessel and said first capacitive coupling element includes means for facilitating a prevention of any occurrence of cracks of any type in the discharge vessel as a result of piezoelectric properties of the first electrically insulating material.

2. The low-pressure gas discharge lamp of claim 1, further comprising:

a second capacitive coupling element being coupled to said discharge vessel to further facilitate the generation of the discharge in said discharge space, said second capacitive coupling element including a second electrically insulating material wherein at least one of said discharge vessel and said second capacitive coupling element includes means for facilitating a prevention of any occurrence of cracks of any type in the discharge vessel as a result of piezoelectric properties of the second electrically insulating material.

3. A low-pressure gas discharge lamp, comprising:

a discharge vessel enclosing a discharge space provided with a gas filing in a gastight manner; and a first capacitive coupling element being coupled to said discharge vessel to generate and maintain a discharge in said discharge space, said first capacitive coupling element including electrically insulating material wherein a first region of said discharge vessel adjacent said first capacitive coupling element has a first reduced thickness to facilitate a prevention of any occurrence of cracks of any type in the discharge vessel as a result of piezoelectric properties of the first electrically insulating material.

4. The low-pressure gas discharge lamp of claim 3, further comprising:

a second capacitive coupling element being coupled to said discharge vessel to further facilitate the generation of the discharge in said discharge space, said second capacitive coupling element including a second electrically insulating material wherein a second region of said discharge vessel adjacent said second capacitive coupling element has a second reduced thickness to facilitate a prevention of any occurrence of cracks of any type in the discharge vessel as a result of piezoelectric properties of the second electrically insulating material.

5. A low-pressure gas discharge lamp, comprising:

a discharge vessel enclosing a discharge space provided with a gas filing in a gastight manner;

a first capacitive coupling element being coupled to said discharge vessel to generate and maintain a discharge in said discharge space, said first capacitive coupling element including electrically insulating material wherein a first region of said first capacitive coupling element has a first reduced thickness to facilitate a prevention of any occurrence of cracks of any type in the discharge vessel as a result of piezoelectric properties of the first electrically insulating material.

6. The low-pressure gas discharge lamp of claim 5, wherein said first region of said first capacitive coupling is coupled to said discharge vessel.

7. The low-pressure gas discharge lamp of claim 5, wherein said first region of said first capacitive coupling is spaced from said discharge vessel.

8. The low-pressure gas discharge lamp of claim 5, further comprising:

a second capacitive coupling element being coupled to said discharge vessel to further facilitate the generation of the discharge in said discharge space, said second capacitive coupling element including a second electrically insulating material wherein a second region of said second capacitive coupling element has a second reduced thickness to facilitate a prevention of any occurrence of cracks of any type in the discharge vessel ass a result of piezoelectric properties of the second electrically insulating material.

9. The low-pressure gas discharge lamp of claim 8, wherein said second region of said second capacitive coupling is coupled to said discharge vessel.

10. The low-pressure gas discharge lamp of claim 8, wherein said second region of said second capacitive coupling is spaced from said discharge vessel.

* * * * *